US006694293B2

(12) United States Patent
Benyassine et al.

(10) Patent No.: US 6,694,293 B2
(45) Date of Patent: Feb. 17, 2004

(54) SPEECH CODING SYSTEM WITH A MUSIC CLASSIFIER

(75) Inventors: Adil Benyassine, Irvine, CA (US); Huan-Yu Su, San Clemente, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 421 days.

(21) Appl. No.: 09/782,883

(22) Filed: Feb. 13, 2001

(65) Prior Publication Data

US 2002/0161576 A1 Oct. 31, 2002

(51) Int. Cl.[7] ..... G10L 19/02

(52) U.S. Cl. ..... 704/229; 704/219; 704/220; 704/233

(58) Field of Search ..... 704/219, 229, 704/233, 220, 231, 236

(56) References Cited

U.S. PATENT DOCUMENTS 6,108,626 A * 8/2000 Cellario et al. ..... 704/230
2003/0009325 A1 * 1/2003 Kirchherr et al. ..... 704/211

OTHER PUBLICATIONS

Anil Ubale et al. "Multi–Band CELP Coding of Speech and Music," Proc. 1997 IEEE Workshop on Speech Coding for Telecommunications, Sep. 1997, p. 101–102.*

Antti Vahatalo et al. "Voice Activity Detection for GSM Adaptive Multi–Rate Codec," 1999 IEEE Workshop on Speech Coding, Jun. 1999, p. 55–57.*

Carey, Micheal J., et al., "A Comparison of Features for Speech, Music Discrimination," IEEE, Mar. 1999, pp. 149–152.

El–Maleh, Khaled, et al., "Speech/Music Discrimination for Multimedia Applications," Dept. Electrical & Computer Engineering, McGill University, Montreal, Quebec, Canada, 3 pgs.

Scheirer, Eric, et al., "Construction and Evaluation of a Robust Multifeature Speech/Music Discriminator," IEEE, 1997, pp. 1331–1334.

* cited by examiner

*Primary Examiner*—Vijay Chawan
(74) *Attorney, Agent, or Firm*—Farjami & Farjami LLP

(57) ABSTRACT

The invention provides a speech coding system with a music classifier. An encoder is disposed to receive an input signal and provides a bitstream based upon a speech coding of a portion of the input signal. The encoder provides a classification of the input signal as one of noise, speech, and music. The music classifier analyzes or determines signal properties of the input signal. The music classifier compares the signal properties to thresholds to determine the classification of the input signal.

25 Claims, 2 Drawing Sheets

SPEECH CODING SYSTEM WITH A MUSIC CLASSIFIER

BACKGROUND OF THE INVENTION

1. Technical Field

This invention relates generally to digital coding systems. More particularly, this invention relates to classification systems for speech coding.

2. Related Art

Telecommunication systems include both landline and wireless radio systems. Wireless telecommunication systems use radio frequency (RF) communication. Currently, the frequencies available for wireless systems are centered in frequency ranges around 900 MHz and 1900 MHz. The expanding popularity of wireless communication devices, such as cellular telephones is increasing the RF traffic in these frequency ranges. Reduced bandwidth communication would permit more data and voice transmissions in these frequency ranges, enabling the wireless system to allocate resources to a larger number of users.

Wireless systems may transmit digital or analog data. Digital transmission, however, has greater noise immunity and reliability than analog transmission. Digital transmission also provides more compact equipment and the ability to implement sophisticated signal processing functions. In the digital transmission of speech signals, an analog-to-digital converter samples an analog speech waveform. The digitally converted waveform is compressed (encoded) for transmission. The encoded signal is received and decompressed (decoded). After digital-to-analog conversion, the reconstructed speech is played in an earpiece, loudspeaker, or the like.

The analog-to-digital converter uses a large number of bits to represent the analog speech waveform. This larger number of bits creates a relatively large bandwidth. Speech compression reduces the number of bits that represent the speech signal, thus reducing the bandwidth needed for transmission. However, speech compression may result in degradation of the quality of decompressed speech. In general, a higher bit rate results in a higher quality, while a lower bit rate results in a lower quality.

Modern speech compression techniques (coding techniques) produce decompressed speech of relatively high quality at relatively low bit rates. One coding technique attempts to represent the perceptually important features of the speech signal without preserving the actual speech waveform. Another coding technique, a variable-bit rate encoder, varies the degree of speech compression depending on the part of the speech signal being compressed. Typically, perceptually important parts of speech (e.g., voiced speech, plosives, or voiced onsets) are coded with a higher number of bits. Less important parts of speech (e.g., unvoiced parts or silence between words) are coded with a lower number of bits. The resulting average of the varying bit rates can be relatively lower than a fixed bit rate providing decompressed speech of similar quality. These speech compression techniques lower the amount of bandwidth required to digitally transmit a speech signal.

These low bit rate speech coding systems may provide suitable speech quality. However, the coded signal quality typically is unacceptable for music due to the low bit rate typically used by speech codecs for this type of signal. Music may be provided by a service or similar feature for playing music while a party is waiting. A radio, stereo, other electronic equipment, a live performance, and the like also may provide music when in proximity for transmission by a communication system.

If a music signal is to be transmitted, the speech coding system should switch to higher bit rates to accommodate the music signal. However, current speech coding systems do not effectively classify when a music signal is present. Typically, a voice activity detector (VAD) is used to differentiate speech and music from noise. However, a VAD does not effectively differentiate between speech and music. As a result, most music signals are transmitted at lower bit rates or a combination of lower and higher bit rates.

SUMMARY

The invention provides a speech coding system with a music classifier that provides a classification of an input or speech signal. The classification may be the input signal is noise, speech, or music. The music classifier analyzes or determines signal properties of the input signal. The music classifier compares the signal properties to thresholds to determine the classification of the input signal.

In one aspect, the speech coding system with a music classifier comprises an encoder disposed to receive an input signal. The encoder provides a bitstream based upon a speech coding of a portion of the input signal. The speech coding has a bit rate. The encoder provides a classification of the input signal. The classification comprises at least music. The encoder adjusts the bit rate in response to the classification of the input signal.

In a method of classifying music in speech coding system, one or more first signal parameters are determined in response to an input signal. The first signal parameters are compared to at least one noise threshold. When the first signal parameters are not beyond the noise threshold, the input signal is classified as noise. When the first signal parameters are beyond the noise threshold, one or more second signal parameters are determined in response to the input signal. The second signal parameters are compared to at least one music threshold. When the second signal parameters are beyond the music threshold, the input signal is classified as speech. When the second signal parameters are not beyond the music threshold, the input signal is classified as music.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
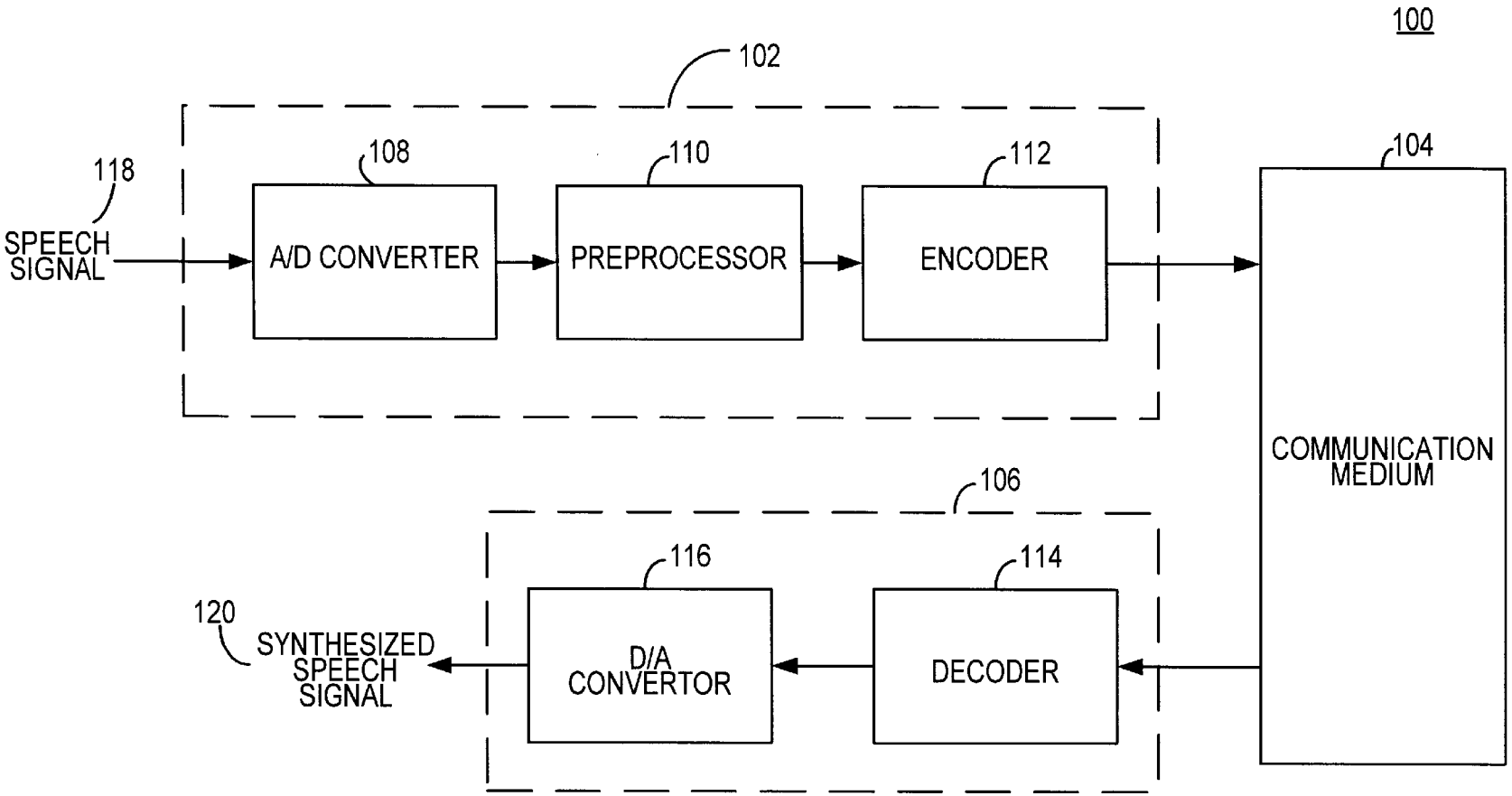
FIG. 1 is a block diagram of a speech coding system having a music classifier.

FIG. 1 is a block diagram of a speech coding system 100 with a music classifier. The speech coding system 100 includes a first communication device 102 operatively connected via a communication medium 104 to a second communication device 106. The speech coding system 100 may be any cellular telephone, radio frequency, or other telecommunication system capable of encoding a speech signal 118 and decoding it to create synthesized speech 120. The communication devices 102 and 106 may be cellular telephones, portable radio transceivers, and other wireless or wireline communication systems. Wireline systems may include Voice Over Internet Protocol (VoIP) devices and systems.

The communication medium 104 may include systems using any transmission mechanism, including radio waves, infrared, landlines, fiber optics, combinations of transmission schemes, or any other medium capable of transmitting digital signals. The communication medium 104 may also include a storage mechanism including a memory device, a storage media or other device capable of storing and retrieving digital signals. In use, the communication medium 104 transmits digital signals, including a bitstream, between the first and second communication devices 102 and 106.

The first communication device 102 includes an analog-to-digital converter 108, a preprocessor 110, and an encoder 112. Although not shown, the first communication device 102 may have an antenna or other communication medium interface (not shown) for sending and receiving digital signals with the communication medium 104. The first communication device 102 also may have other components known in the art for any communication device.

The second communication device 106 includes a decoder 114 and a digital-to-analog converter 116 connected as shown. Although not shown, the second communication device 106 may have one or more of a synthesis filter, a postprocessor, and other components known in the art for any communication device. The second communication device 106 also may have an antenna or other communication medium interface (not shown) for sending and receiving digital signals with the communication medium 104.

The preprocessor 110, encoder 112, and/or decoder 114 may comprise processors, digital signal processors, application specific integrated circuits, or other digital devices for implementing the algorithms discussed herein. The preprocessor 110 and encoder 112 also may comprise separate components or a same component.

In use, the analog-to-digital converter 108 receives an input or speech signal 118 from a microphone (not shown) or other signal input device. The speech signal may be a human voice, music, or any other analog signal. The analog-to-digital converter 108 digitizes the speech signal, providing a digitized signal to the preprocessor 110. The preprocessor 110 passes the digitized signal through a high-pass filter (not shown), preferably with a cutoff frequency of about 80 Hz. The preprocessor 110 may perform other processes to improve the digitized signal for encoding.

The encoder 112 segments the digitized speech signal into frames to generate a bitstream. In one embodiment, the speech coding system 100 uses frames having 160 samples and corresponding to 20 milliseconds per frame at a sampling rate of about 8000 Hz. The encoder 112 provides the frames via a bitstream to the communication medium 104.

In one embodiment, the encoder 112 comprises a music classifier (not shown), which may have a voice activity detector (not shown). The music classifier provides a classification of the digitized signal in each frame. The classification may be that the input or speech signal is noise, speech, or music. The music classifier may use a voice activity detector (VAD) to differentiate speech and music frames from noise frames. The music classifier further differentiates speech frames from music frames. In one aspect, the music classifier analyzes or determines the signal properties of the digitized signal. The signal properties may include one or more of pitch gain, spectral differences, frame energy, and other suitable properties for differentiating between music and speech. The music classifier compares the signal properties to thresholds to determine whether a frame is music or speech. The music classifier also may have one or more counters or may use one or more running means of the signal properties to provide a confidence level of the determination. The running means and counters may extend over a time period that covers multiple frames. The time period may be about 640 milliseconds.

The decoder 114 receives the bitstream from the communication medium 104. The decoder 114 operates to decode the bitstream and generate a reconstructed speech signal in the form of a digital signal. The reconstructed speech signal is converted to an analog or synthesized speech signal 120 by the digital-to-analog converter 116. The synthesized speech signal 120 may be provided to a speaker (not shown) or other signal output device.

The encoder 112 and decoder 114 use a speech compression system, commonly called a codec, to reduce the bit rate of the noise-suppressed digitized speech signal. There are numerous algorithms for speech codecs that reduce the number of bits required to digitally encode the original speech or digitized signal while attempting to maintain high quality reconstructed speech. The code excited linear prediction (CELP) coding technique utilizes several prediction techniques to remove redundancy from the speech signal. The CELP coding approach is frame-based. Sampled input speech signals (i.e., the preprocessed digitized speech signals) are stored in blocks of samples called frames. The frames are processed to create a compressed speech signal in digital form.

The CELP coding approach uses two types of predictors, a short-term predictor and a long-term predictor. The short-term predictor is typically applied before the long-term predictor. The short-term predictor also is referred to as linear prediction coding (LPC) or a spectral representation and typically may comprise 10 prediction parameters. A first prediction error may be derived from the short-term predictor and is called a short-term residual. A second prediction error may be derived from the long-term predictor and is called a long-term residual. The long-term residual may be coded using a fixed codebook that includes a plurality of fixed codebook entries or vectors. During coding, one of the entries may be selected and multiplied by a fixed codebook gain to represent the long-term residual. The long-term predictor also can be referred to as a pitch predictor or an adaptive codebook and typically comprises a lag parameter and a long-term predictor gain parameter.

The CELP encoder 112 performs an LPC analysis to determine the short-term predictor parameters. Following the LPC analysis, the long-term predictor parameters and the fixed codebook entries that best represent the prediction error of the long-term residual are determined. Analysis-by-synthesis (ABS) is employed in CELP coding. In the ABS approach, synthesizing with an inverse prediction filter and applying a perceptual weighting measure find the best contribution from the fixed codebook and the best long-term predictor parameters.

The short-term LPC prediction coefficients, the adjusted fixed-codebook gain, as well as the lag parameter and the adjusted gain parameter of the long-term predictor are quantized. The quantization indices, as well as the fixed codebook indices, are sent from the encoder to the decoder.

The CELP decoder 114 uses the fixed codebook indices to extract a vector from the fixed codebook. The vector is multiplied by the fixed-codebook gain, to create a fixed codebook contribution. A long-term predictor contribution is added to the fixed codebook contribution to create a synthesized excitation that is commonly referred to simply as an excitation. The long-term predictor contribution comprises the excitation from the past multiplied by the long-term predictor gain. The addition of the long-term predictor contribution alternatively comprises an adaptive codebook contribution or a long-term pitch filtering characteristic. The excitation is passed through a synthesis filter, which uses the LPC prediction coefficients quantized by the encoder to generate synthesized speech. The synthesized speech may be passed through a post-filter that reduces the perceptual coding noise. Other codecs and associated coding algorithms may be used, such as adaptive multi rate (AMR), extended code excited linear prediction (eX-CELP), selectable mode vocoder (SMV), multi-pulse, regular pulse, harmonic based, transform based, and the like.

Figure 2:
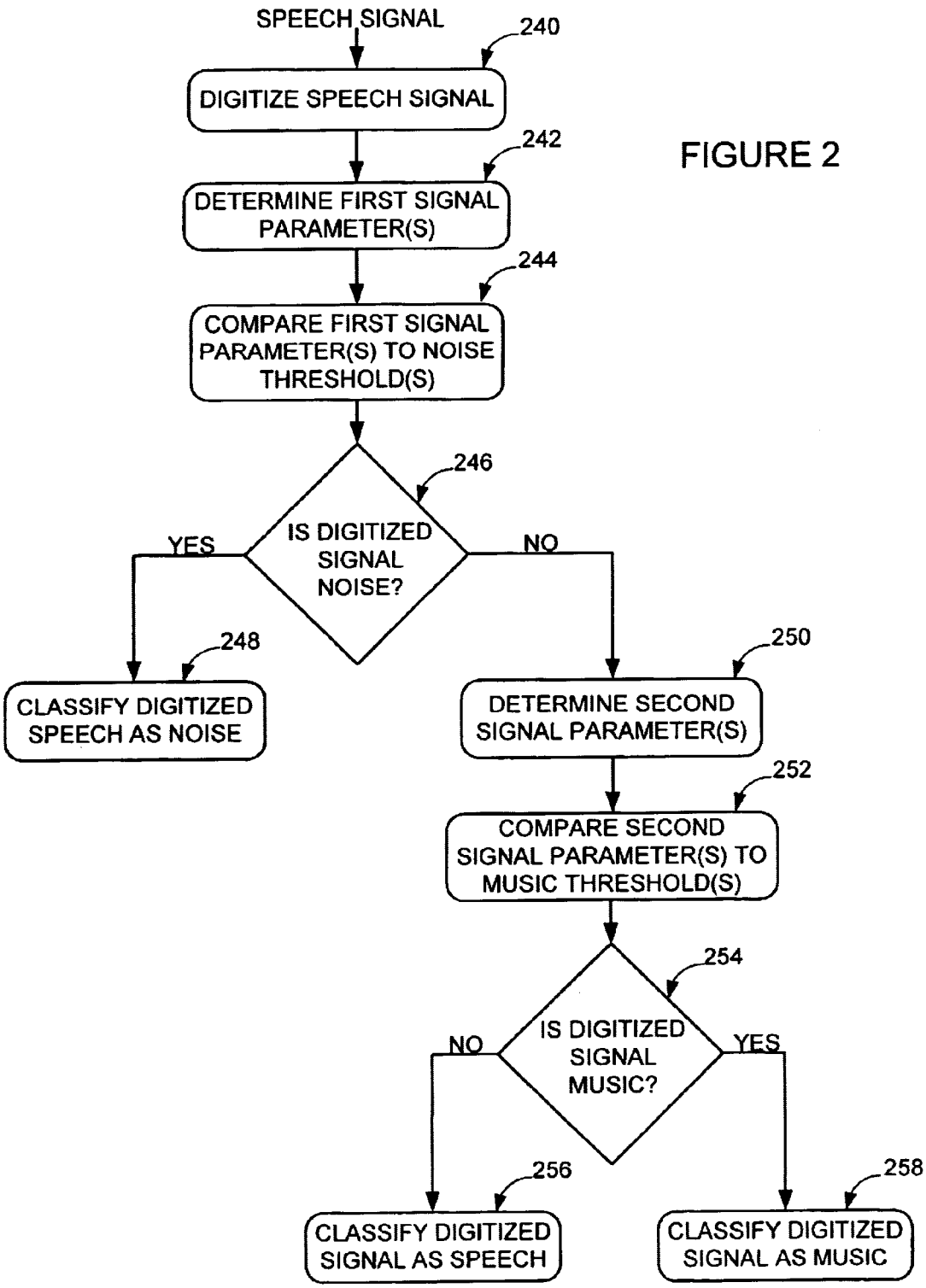
FIG. 2 is a flowchart showing a method of classifying music in a speech coding system.

FIG. 2 shows a method of classifying music in speech coding. In 240, a speech signal is digitized. An analog-to-digital converter or other suitable digitizing device may be used to digitize the signal. In 242, one or more first signal parameters are determined for a frame or portion of the digitized signal. The portion may include a sub-frame, half-frame, or the like. The first signal parameters may comprise a noise-to-signal ratio, frame energy, and other parameters useful to determine whether the frame contains noise. In 244, the first signal parameters are compared to one or more noise thresholds. The noise thresholds may be selected to classify a frame as noise when the digitized signal is all noise, mostly-noise, or another level of noise and speech. A voice activity detector (VAD) or similar device may be used to determine and compare the signal parameters with the noise thresholds. The VAD may provide a detection of both or either of active speech and/or inactive speech. Active speech may comprise music and speech. Inactive speech may comprise noise. In 246, a noise determination is made to determine whether the digitized signal in the frame is noise. If the signal parameters are not beyond the noise thresholds, the digitized signal and the frame are classified in 248 as noise and a noise frame, respectively. If the first signal parameters are beyond the noise thresholds, the digitized signal may be speech or music.

In 250, one or more second signal parameters are determined for the frame. In 252, the second signal parameters are compared to one or more music thresholds. The second signal parameters and music thresholds are further described below. The music thresholds may be selected to classify a frame as music when the digitized signal is all music, mostly-music, or another level of music and speech. The music thresholds also may be selected to classify a frame as speech when the digitized signal is all speech, mostly-speech, or another level of music and speech.

In 254, a music determination is made to determine whether the digitized signal in the frame is music. The music determination may be to determine whether the digitized signal in the frame is speech. If the second signal parameters are beyond the music thresholds, the digitized signal and the frame are classified in 256 as speech and a speech frame, respectively. If the signal parameters are not beyond the music thresholds, the digitized signal and frame are classified in 258 as music and a music frame, respectively.

The music classifier may classify the input or speech signal as either music or speech. This determination or classification may take place after the noise frames are classified. The music classifier may use some of the first signal parameters and extracts the second signal parameters from the speech signal. These parameters are compared to music thresholds to determine whether the input signal is music or speech. While certain signal parameters are described, other or additional signal parameters may be used to determine whether the input signal is music or speech.

The music classifier has a buffer of the five previous normalized pitch correlations, $corr_p(\bullet)$. An lsf(2) and an lsf(1) are obtained from the linear prediction coding, LPC, analysis. The line spectral frequencies, lsf, are transformations of LPC parameters (the short term filter coefficients). The lsf are obtained by decomposing the inverse transfer function A(z) to a set of two transfer functions—one having even symmetry and the other having odd symmetry. The lsf are the roots of these transfer functions (polynomials) on a z-unit circle. A(z) models an inverse frequency response of a vocal tract. A difference $\Delta_{lsf}$ between lsf(2) and lsf(1) is computed.

A running mean of lsf(1) is computed as:

$$\overline{lsf}(1)=0.75\cdot\overline{lsf}(1)+0.25\cdot lsf(1).$$

A running mean energy, $\overline{E}$, is calculated as:

$$\overline{E}=0.75\cdot\overline{E}+0.25\cdot E$$

where E is the frame energy.

A spectral difference SD is calculated as:

$$SD=\sum_{i=1}^{10}(k(i)-\overline{k}_N(i))^2$$

where $\overline{k}_N$ is the running mean reflection coefficients of noise/silence.

The running mean of the partial residual $\overline{E}_N^{res}$ is updated along $\overline{k}_N$ when the input VAD is inactive as:

$$\overline{E}_N^{res}=0.9\cdot\overline{E}_N^{res}+0.1\cdot E^{res}$$

and $$\overline{k}_N(i)=0.75\cdot\overline{k}_N(i)+0.25\cdot k(i)\ i=1,\ldots,10.$$

A running mean of the normalized pitch correlation is given by:

$$\overline{corr}_p=0.8\cdot\overline{corr}_p+0.2\cdot\left(\frac{1}{5}\cdot\sum_{i=1}^{i=5}corr_p(i)\right).$$

A periodicity flag $F_p$ is calculated using $corr_p(\bullet)$ and different music thresholds. A spectral continuity counter $c_{sp}$ is incremented if $k(2)\geqq 0.0$ and $\overline{corr}_p<0.5$ and reset to 0 otherwise. A periodicity continuity counter $c_{pr}$ is incremented each time $F_p$ is set and reset to 0 every 32 frames.

A running mean of the periodicity counter $\overline{c}_{pr}$ is updated every 32 frames as:

$$\overline{c}_{pr}=a\cdot\overline{c}_{pr}+(1-\alpha)\cdot c_{pr}$$

where $$\alpha = \begin{cases} 0.98 & c_{pr} > 12 \\ 0.95 & c_{pr} > 10 \\ 0.90 & \text{otherwise.} \end{cases}$$

A counter $c_{cpr}$ tracks the behavior of $c_{pr} \cdot c_{cpr}$ is incremented each time $c_{pr}$ is 0 and is reset otherwise.

A very low frequency noise flag $F_f$ is set if the initial VAD is inactive and either lsf(1)<110 Hertz or $\overline{\text{lsf}}$(1)<150 Hertz. The initial inactive VAD decision from the VAD module may be corrected to an active VAD decision by comparing $SD_4$, $E^{res}$, $\overline{E}$hd $N^{res}$, E, and $\overline{c}_{pr}$ to a set of thresholds. A noise continuity counter $c_N$ is incremented each time the corrected VAD is inactive and is reset otherwise.

A running mean of the normalized pitch correlation $\overline{\text{corr}}_p^N$ is updated if either the corrected VAD is inactive or $F_f$ is set. The normalized pitch correlation $\overline{\text{corr}}_p^N$ essentially tracks the normalized pitch correlation during noise/silence:

$$\overline{corr}_p^N = 0.8 \cdot \overline{corr}_p^N + 0.2 \cdot \left( \frac{1}{5} \cdot \sum_{i=1}^{i=5} corr_p(i) \right)$$

A music continuity counter $c_M$ is adaptively incremented and decremented by comparing the signal parameters to each other and to a set of music thresholds, controlled by the various flags. The music counter $c_M$, the other counters, and other parameters may be modified, determined, or otherwise obtained through one or more statistical analysis of the input or speech signal.

A running mean of this counter $\overline{c}_M$ is updated as:

$$\overline{c}_M = 0.9 \cdot \overline{c}_M + 0.1 \cdot c_M.$$

The music detection flag $F_M$ is set if either $\overline{c}_{pr} \geqq 18$ or $\overline{c}_M > 200$. In this case, $\overline{E}_N^{res}$ is reset to 0. $\overline{c}_{pr}$, $c_{pr}$, and $c_{sp}$ are reset to 0 if either E<13 dB or $F_f$ is set or $c_{cpr} > 50$, or $c_{sp} > 20$. $C_M$ and $\overline{c}_M$ are set to 0 if $c_N > 50$.

Another method of classifying music in speech coding utilizes the following computer code, written in the C programming language. The C programming language is well known to those having skill in the art of speech coding and speech processing. The following C programming language code may be performed within the 250, 252, and 254 of FIG. 2.

```
MLLenergy=0.75*MLLenergy+0.25*LLenergy;
dif_dvector(mrc,rc,tmp_vec,0,NP-1);
dot_dvector(tmp_vec,tmp_vec,&SD, 0,NP-1);
```

```
if(* Vad = = NOISE)
    {
    MeanSE = 0.9*MeanSE + 0.1*Lenergy;
    wad_dvector(mrc, 0.75, rc, 0.25, mrc, 0, NP-1);
    }
sum2 = 0.0;
for(i = 0; i < 5; i++)
    sum2 + = pgains[i];
sum2 = sum2/5.0;
if(LLenergy < 10.0)
    sum2 = MIN(pgains[3], pgains[4]);
MeanPgain = 0.8*MeanPgain + 0.2*sum2;
if( MeanPgain > 0.63)
    PFLAG2 = 1;
else
```

-continued

```
    PFLAG2 = 0;
if( std < 1.30 && MeanPgain > 0.45 )
    PFLAG1 = 1;
else
    PFLAG1 = 0;
PFLAG = (INT16) ( ((INT16)prev_vad && (INT16)
    (PFLAG1 || PLAG2)) || (INT16) (PLAG2))
if(rc[1] >= 0.0 && MeanPgain < 0.5)
    count_consc_rflag++
else
    count_consc_rflag = 0;
if(PFLAG = =1)
    count_pflag++;
if((frm_count%(64/2)) = =0 )
    {
    if( frm_count = = 64/2)
        Mcount_pflag = (FLOAT64) count_pflag;
    else
        {
        if(count_pflag > 25/2)
            Mcount_pflag = 0.98*Mcount_pflag +
0.02*(FLOAT64)count_pflag;
        else if(count_pflag > 20/2)
            Mcount_pflag = 0.95*Mcount_pflag +
0.05*(FLOAT64)count_pflag;
        else
            Mcount_pflag = 0.90*Mcount_pflag +
0.10*(FLOAT64)count_pflag;
        }
    }
if(count_pflag = = 0)
    count_consc_pflag++;
else
    count_consc_pflag = 0;
vlow_freg_noise = 0
If ( (*Vad = = NOISE) && (1sf0 < 110.0/8000.0 ||
    (MAX (1sf0,m1sf0) < 150.0/8000.0) ))
    vlow_freq_noise = 1;
if(MLLenergy < 13.0 || vlow_freq_noise = = 1 ||
    count_consc_pflag > 50 || count_consc_rflag > 20)
    {
    Mcount_pflag = 0.0;
    count_consc_pflag = 0;
    count_consc_rflag = 0;
    }
if((frm_count%(64/2)) = =0)
    count_pflag = 0;
if(SD > 0.15 && (Lenergy MeansSE) > 4.0 && (LLenergy> 50.0) )
    *Vad = VOICE;
else if((SD > 0.38 || (Lenergy − MeansSE)> 4.0 ) && (LLenergy> 50.0))
    *VAD = VOICE;
else if(Mcount_pflag >= 11.0)
    *Vad = VOICE;
if(*Vad = = NOISE)
    count_consc_nflag++;
else
    count_consc_nflag = 0;
if( count_consc_nflag > 50)
    {
    mus_update = 0;
    mean_mus_update = 0.0;
    }
if(MLLenergy < 13.0)
    mus_update = MAX (0, mus_update − 10);
else if(*Vad = = NOISE || vlow_freq_noise = = 1)
    {
    NMeanPgain = 0.8*NMeanPgain + 0.2*sum2;
    if( vlow_freq_noise = = 1 || (NMeanPgain < 0.55 &&
        (( (Lenergy − MeansSE)<2.0) ||
            (MeanPgain < 0.45 && SD < 0.050) )))
                mus_update = MAX(0, mus_update − 100);
    }
else if(rc[1] < 12.8*delta_1sf −0.8 || MeanPgain > 0.667 *rc[1] + 1.2667)
    {
    diff1 = 12.8*delta_1sf −0.8 − rc[1];
    diff2 = MeanPgain − 0.667*rc[1] − 1.2667;
    mus_update = MAX(0, mus_update−1000*MAX(diff1,diff2));
    }
else if((Lenergy −MeanSE)> 4.0)
```

-continued

```
    {
    if(NMeanPgain > 0.75 && mrc[1] < 0.55)
        mus_update = MIN(mus_update+100,32767);
    else
        mus_update = MIN(mus_update+1,32767);
    }
mean_mus_update = 0.9*mean_mus_update + 0.1*mus_update;
if((Mcount_pflag >= 18.0) || mean_mus_update > 200.0)
    {
    music_flg =1;
    MeanSE = 0.0;
    }
else
    music_flg = 0;
/*-----------------------------------------------------------------*/
return(music_flg);
```

The variables in the computer code correspond to the variables in the method associated with FIG. 2 as shown in Table 1.

TABLE 1

| Description Variables | C-code Variables |
|---|---|
| $\underline{E}$ | LLenergy |
| $\overline{E}$ | MLLenergy |
| $\underline{k}$ | Rc |
| $\overline{k}_N$ | Mrc |
| $\underline{SD}$ | SD |
| $\overline{E}_N^{res}$ | MeanSE |
| $E^{res}$ | Lenergy |
| $\underline{corr}_p$ | Pgains |
| $\overline{corr}_p$ | MeanPgain |
| $F_p$ | PFLAG |
| $c_{sp}$ | count_consc_rflag |
| $\underline{c}_{pr}$ | count_pflag |
| $\overline{c}_{pr}$ | Mcount_pflag |
| $c_{cpr}$ | count_consc_pflag |
| $F_f$ | vlow_freq_noise |
| $c_N$ | count_consc_nflag |
| $\underline{c}_M$ | music_update |
| $\overline{corr}_p^N$ | NMeanPgain |
| $\Delta_{lsf}$ | delta_lsf |
| $\underline{lsf}(1)$ | lsf0 |
| $\overline{lsf}(1)$ | mlsf0 |

After a frame or portion of the input or speech signal is classified as music or a music frame, the speech coding of the music frame may be done at higher bit rates to accommodate the music signal. In an alternate embodiment, the speech coding of the music frame is done to reduce or essentially eliminate music from the synthesized speech signal. In one aspect, an essentially zero gain is applied to a codevector representing a signal waveform of the music frame.

The embodiments discussed in this invention are discussed with reference to speech signals, however, processing of any analog signal is possible. It also is understood the numerical values provided may be converted to floating point, decimal point, fixed point, or other similar numerical representation that may vary without compromising functionality. Further, functional blocks identified as modules are not intended to represent discrete structures and may be combined or further sub-divided in various embodiments. Additionally, the speech coding system may be provided partially or completely on one or more Digital Signal Processing (DSP) chips. The DSP chip may be programmed with source code. The source code may be first translated into fixed point, and then translated into a programming language that is specific to the DSP. The translated source code then may be downloaded into the DSP. One example of source code is the C or C++ language source code. Other source codes may be used.

While various embodiments of the invention have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. A speech coding system with a music classifier, the speech coding system comprising:

an encoder disposed to receive an input signal, the encoder to provide a bitstream based upon a speech coding of a portion of the input signal, the speech coding having a bit rate;

wherein the encoder includes a voice activity detector to differentiate active speech from noise in the input signal;

wherein the encoder provides a classification of the active speech, wherein the classification comprises music and voice; and wherein the encoder adjusts the bit rate in response to the classification of the active speech, such that the bit rate is higher for music than voice.

2. The speech coding system according to claim 1, where the speech coding comprises code excited linear prediction (CELP).

3. The speech coding system according to claim 1, where the speech coding comprises extended code excited linear prediction (eX-CELP).

4. The speech coding system according to claim 1, where the portion of the input signal is one of a frame, a sub-frame, and a half frame.

5. The speech coding system according to claim 1, where the encoder comprises a digital signal processing (DSP) chip.

6. The speech coding system according to claim 1, further comprising a decoder operatively connected to receive the bitstream from the encoder, the decoder to provide a reconstructed signal based upon the bitstream.

7. The speech coding system according to claim 1, where the encoder compares at least one signal parameter to at least one threshold to determine the classification of the active speech.

8. The speech coding system according to claim 7, where the at least one signal parameter comprises at least one of a frame energy, line spectral frequencies, a spectral difference, a partial residual, a normalized pitch correlation, and at least one counter.

9. The speech coding system according to claim 8, where the at least one counter comprises at least one of a spectral continuity counter, a periodicity continuity counter, a noise continuity counter, and a music continuity counter.

10. The speech coding system according to claim 7, where at least one of the at least one signal parameter comprises a running mean.

11. The speech coding system according to claim 1, where the encoder compares a plurality of signal parameters to a plurality of thresholds to determine the classification of the active speech.

12. The speech coding system according to claim 11, where the plurality of signal parameters comprise a frame energy, line spectral frequencies, a spectral difference, a partial residual, a normalized pitch correlation, and a plurality of counters.

13. The speech coding system according to claim 12, where the plurality of counters comprise a spectral continuity counter, a periodicity continuity counter, a noise continuity counter, and a music continuity counter.

14. The speech coding system according to claim 11, where the plurality of signal parameters comprise a running mean.

15. A method of classifying music in a speech coding system, the method comprising:

differentiating active speech from noise in an input signal;

providing a classification of active speech, wherein the classification comprises music and voice; and adjusting a coding bit rate in response to the classification of the active speech, such that the coding bit rate is higher for music than voice.

16. The method according to claim 15, where the speech coding system comprises code excited linear prediction (CELP).

17. The method according to claim 15, where the speech coding system comprises extended code excited linear prediction (eX-CELP).

18. The method according to claim 15, where the providing step compares at least one signal parameter to at least one threshold to determine the classification of the active speech.

19. The method according to claim 18, where the at least one signal parameter comprises at least one of a frame energy, line spectral frequencies, a spectral difference, a partial residual, a normalized pitch correlation, and at least one counter.

20. The method according to claim 19, where the at least one counter comprises at least one of a spectral continuity counter, a periodicity continuity counter, a noise continuity counter, and a music continuity counter.

21. The method according to claim 18, where at least one of the at least one signal parameter comprises a running mean.

22. The method according to claim 15, where the providing step compares a plurality of signal parameters to a plurality of thresholds to determine the classification of the active speech.

23. The method according to claim 22, where the plurality of signal parameters comprise a frame energy, line spectral frequencies, a spectral difference, a partial residual, a normalized pitch correlation, and a plurality of counters.

24. The method according to claim 23, where the plurality of counter comprise a spectral continuity counter, a periodicity continuity counter, a noise continuity counter, and a music continuity counter.

25. The method according to claim 22, where the plurality of signal parameters comprise a running mean.

* * * * *